US005251615A

United States Patent [19]

Sheen

[11] Patent Number: 5,251,615

[45] Date of Patent: Oct. 12, 1993

[54] CHAIR STRUCTURE

[75] Inventor: Ruey C. Sheen, Taipei, Taiwan

[73] Assignee: Wei Ri Healthy Chair Co., Tainan, Taiwan

[21] Appl. No.: 913,701

[22] Filed: Jul. 16, 1992

[51] Int. Cl.[5] ..... A61H 15/00

[52] U.S. Cl. ..... 128/57; 128/33; 128/24.3

[58] Field of Search ..... 128/25 B, 33, 57, 24.3, 128/24.4, 58.60, 61; 297/452

[56] References Cited

U.S. PATENT DOCUMENTS

| | | | |
|---|---|---|---|
| 1,164,356 | 12/1915 | Kaiser | 128/33 |
| 1,700,633 | 1/1929 | Hendrickson | 128/58 |
| 2,840,072 | 6/1958 | Stearns | 128/57 |
| 3,899,115 | 8/1975 | Simjian | 128/58 |
| 4,369,533 | 1/1983 | Gisiger | 128/33 |
| 5,506,506 | 10/1991 | Verduci | 128/33 |

*Primary Examiner*—Robert A. Hafer
*Assistant Examiner*—David J. Kenealy
*Attorney, Agent, or Firm*—Finnegan, Henderson, Farabow, Garrett & Dunner

[57] ABSTRACT

An improved chair structure includes a frame having a vertical portion and a horizontal portion which is mounted on a body. A plurality of flexible supports are arranged across the vertical frame portion and the horizontal frame portion and a first line of rollers and a second line of rollers are arranged parallel to each other and perpendicular to the flexible supports in the vertical frame portion, while a third line and a fourth line of rollers are similarly arranged in the horizontal frame portion. The first line of rollers and the second line of rollers are symmetrical about a central line of the vertical frame portion and are separated by a distance greater than a human's spine; the third line and the fourth line of rollers are also symmetrical about a central line of the horizontal frame portion and are separated by a distance greater than a human's bottom; such that when a user sits on the chair and lies against the vertical frame portion, his spine and bottom are respectively located between two lines of rollers which produce a massaging effect thereon.

6 Claims, 3 Drawing Sheets

CHAIR STRUCTURE

FIELD OF THE INVENTION

This invention relates to an improved chair structure, particularly to one which has flexible supports arranged therein.

BACKGROUND OF THE INVENTION

A common chair used at the present time is either provided with a plurality of parallel supports in the frame thereof for ventilation or provided with sofa-style cushioning for a soft feeling. However, the former has the drawback of being too stiff whilst the latter has the drawback of being not ventilative. Therefore, the inventor of the present invention provides an improved chair structure which eliminates the above drawbacks.

SUMMARY OF THE INVENTION

The primary objective of the present invention is to provide an improved chair structure on which a user sitting thereupon feels a massaging effect by two lines of rollers arranged beside his spine and another two lines of rollers beside his bottom.

In accordance with one aspect of the invention, an improved chair structure includes a frame having a vertical portion and a horizontal portion which is mounted on a body, a plurality of flexible support means being horizontally attached across the vertical portion of the frame, a roller means being rotatably attached between each two adjacent flexible support means thereby constituting a first line of roller means substantially perpendicular to the flexible support means, a second line of roller means being formed parallel to the first line of roller means with both lines being symmetrical about a central line of the vertical portion of the frame and having a distance greater than a human's spine width, each roller means having a rotating axis perpendicular to the flexible support means, such that a user's spine is located between the two roller lines to produce a massaging effect when he sits against the vertical frame portion.

In accordance with another aspect of the invention, the improved chair structure further includes a plurality of flexible support means being horizontally attached across the horizontal portion of the frame, a roller means being rotatably attached between each two adjacent flexible support means of the horizontal frame thereby constituting a third line of roller means substantially perpendicular to the flexible support means, a fourth line of roller means being formed parallel to the third line of roller means with both lines being symmetrical about a central line of the horizontal frame and having a distance greater than a human's bottom width, each roller means having a rotating axis perpendicular to the flexible support means, such that a user's bottom is located between the two roller lines to produce a massaging effect therefrom when seated.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 1:
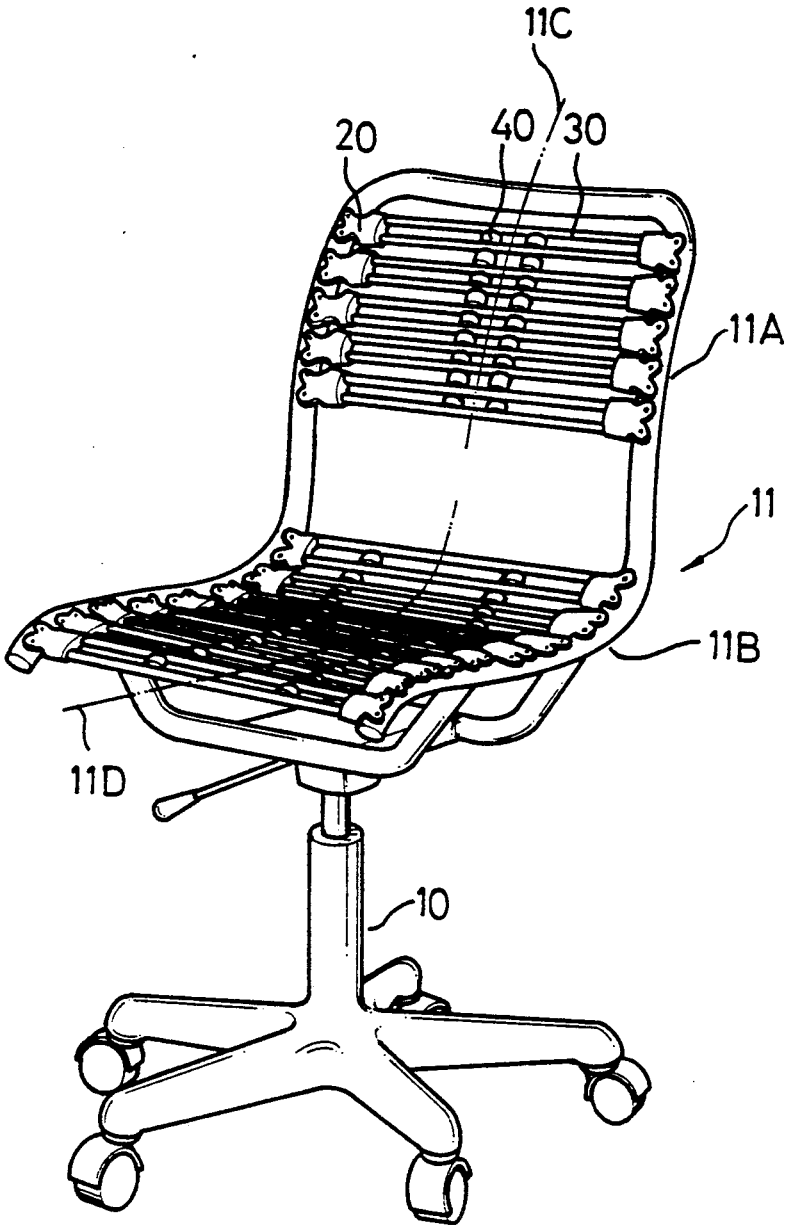
FIG. 1 is an improved chair structure in accordance with the present invention.

Referring to FIG. 1, an improved chair structure comprises a frame 11 having a vertical portion 11A and a horizontal portion 11B which is mounted on a body 10. A plurality of flexible support means 30 are horizontally attached across the vertical portion 11A. A portion of the vertical frame 11A near the horizontal frame 11B is not arranged with flexible support means 30 because it does not normally contact with a seated user. A roller means 40 is rotatably attached between adjacent each two flexible support means 30, thereby constituting a first line of roller means 40 substantially perpendicular to the flexible support means 30. A second line of roller means 40 is located parallel to the first line of roller means 40 with both lines being symmetrical about a central line 11C of the vertical portion 11A and having a distance therebetween greater than a human's spine width, such that a user's spine is located between the two roller lines when seated to produce a massaging effect therefrom. The two lines of roller means 40 also have the effect of equivalently distributing tension resulting from a user's weight, thereby preventing a localized extension of the flexible support means 30 when the user sits thereon. Each of the roller means 40 has a rotating axis perpendicular to the flexible support means 30. A length of wire 42, or similar device such as a plurality of pins, is threaded through the flexible support means 30 and the roller means 40 to serve as a rotating axle for the roller means 40.

The number of roller means 40 between each two adjacent support means 30 is not limited to one; other numbers are possible.

Figure 2:
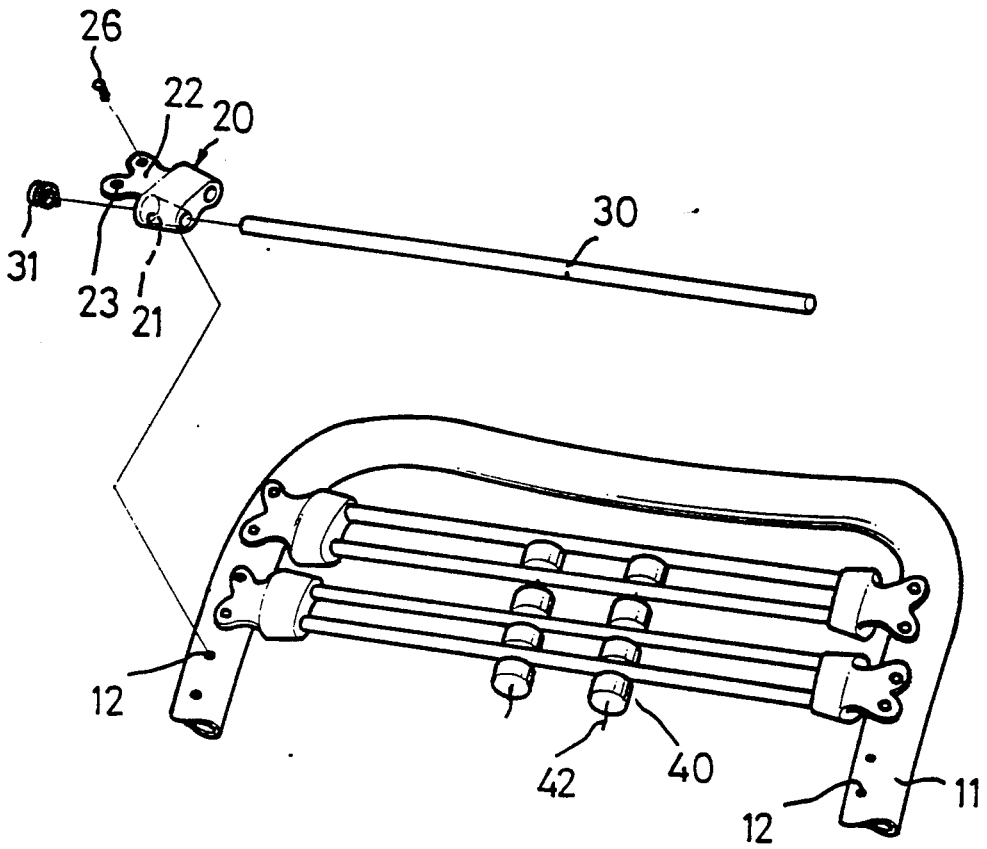
FIG. 2 is a portional view of the chair in FIG. 1.
Figure 3:
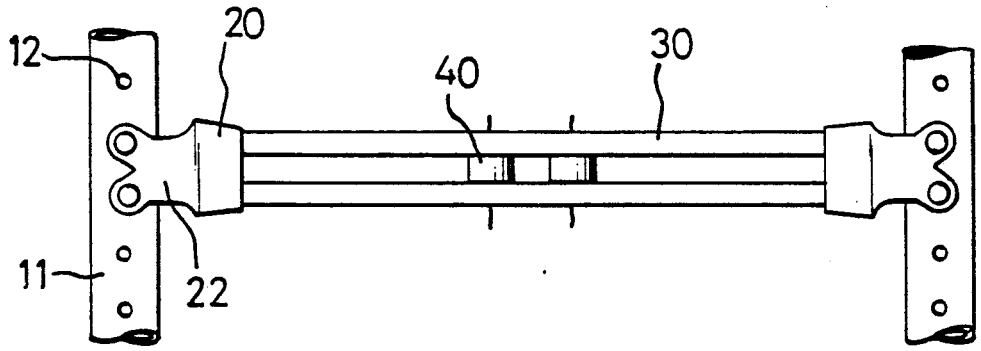
FIG. 3 illustrates a portion of FIG. 2 in more detail.

Referring to FIGS. 2 and 3, a pair of engaging means 20 are engaged between each end of each support means 30 and the vertical frame 11A. The engaging means 20 comprises at least one funnel hole 21 to receive one end of the flexible support 30, a corresponding securing ring 31 received in the funnel hole 21 for securing to the end of the flexible support 30, and an ear portion 22 being secured to the vertical frame 11A. The ear portion 22 and the vertical frame are respectively formed with holes 23 and 12, such that a bolt 26 is locked through the holes 23 and 12 securing the engaging means 20 to the vertical frame 11A. The funnel hole 21 has a small opening and a large opening, so that the securing ring 31 can be inserted into the large opening but cannot pass through the small opening. Each pair of engaging means 40 together with the support means 30 therebetween constitute a supporting unit which is very convenient to be arranged/rearranged on the frame 11.

Referring to FIG. 1 again, a plurality of flexible support means 30 are also horizontally arranged across the horizontal frame portion 11B. A roller means 40 is attached between each two adjacent flexible support means 30 constituting a third line of roller means 40 substantially perpendicular to the flexible support means 30. A fourth line of roller means 40 is located parallel to the first line of roller means 40 with both lines being symmetrical about a central line 11D of the horizontal frame portion 11B and having a distance greater than a human's bottom, such that a user's bottom is located between the two roller lines to produce a massaging effect when seated. Each of the roller means 40 has a rotating axis perpendicular to the flexible support means 30. A length of wire or similar device such as a plurality of pins is threaded through the flexible support means 30 and the roller means 40 to serve as a rotating axle for the roller means 40. The number of roller means 40 between each two adjacent support means 30 is not limited to one; other numbers are possible. A pair of engaging means 20 are also engaged between each end of each support means 30 and the horizontal frame portion 11B. The structure of the engaging means 20 and the horizontal frame portion 11B are exactly the same as mentioned above.

As known, a human's back, especially along the spine, has a lot of nerves. A user can have his back treated with magnetic flux to experience relaxing effect. Therefore, the roller means 40 is composed of a magnetic material for forming magnetic fluxes therearound, thereby treating the nerve ends and muscles of a user's back and bottom with these magnetic fluxes.

Figure 4:
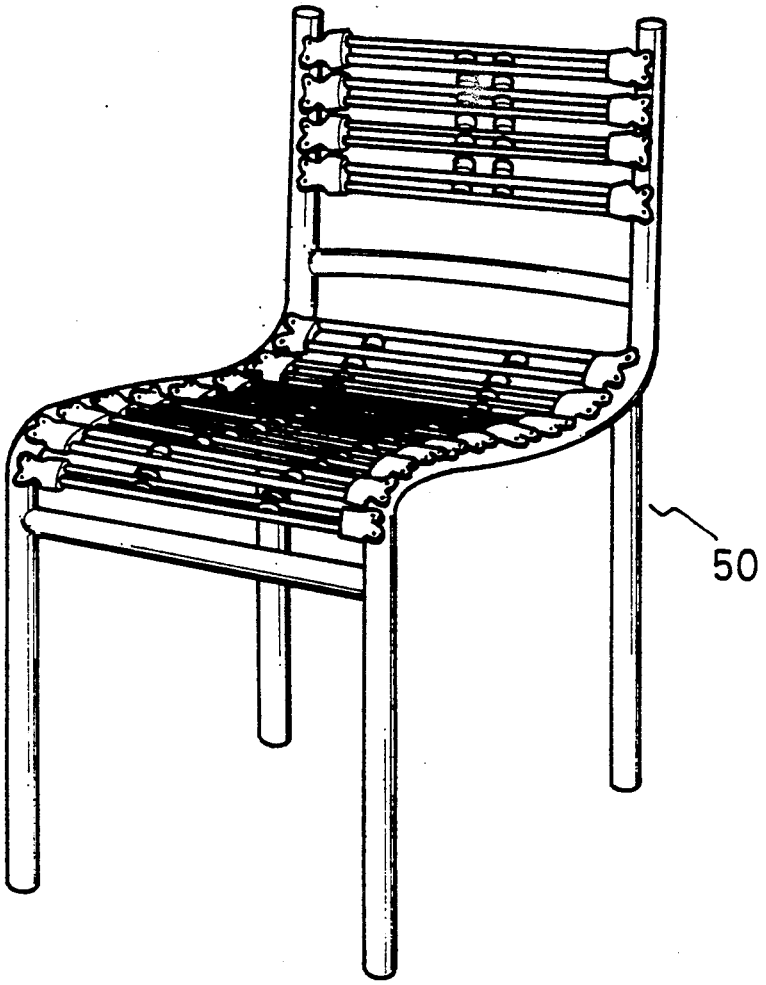
FIG. 4 is another embodiment of the present invention.

Referring to FIG. 4, another embodiment of the present invention, showing a different frame 50 of the chair is illustrated, however, the other components are exactly as mentioned in FIG. 1.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. An improved chair structure comprising a frame having a vertical portion and a horizontal portion which is mounted on a body, a plurality of flexible support means being horizontally attached across said vertical portion, a roller means being rotatably attached between each two adjacent flexible support means thereby constituting a first line of roller means substantially perpendicular to said flexible support means, a second line of roller means being formed parallel to said first line of roller means with both lines being symmetrical about a central line of said vertical portion, such that a user's spine is located between said two roller lines when seated, each of said roller means having a rotating axis perpendicular to said flexible support means, a pair of engaging means being engaged between each end of each said support means and said vertical frame portion, each said engaging means comprising at least one funnel hole to receive one end of said flexible support means, a corresponding securing ring being secured to the end of said flexible support means, and an ear portion being secured to said vertical frame portion.

2. An improved chair structure comprising a frame having a vertical portion and a horizontal portion which is mounted on a body, a plurality of flexible support means being horizontally attached across said vertical portion, a roller means being rotatably attached between each two adjacent flexible support means thereby constituting a first line of roller means substantially perpendicular to said flexible support means, a second line of roller means being formed parallel to said first line of roller means with both lines being symmetrical about a central line of said vertical portion, such that a user's spine is located between said first and second roller lines when seated, each of first and second said roller means having a rotating axis perpendicular to said flexible support means, a plurality of flexible support means being horizontally attached across said horizontal portion, a roller means being attached between each two adjacent flexible support means thereby constituting a third line of roller means substantially perpendicular to said flexible support means, a fourth line of roller means being formed parallel to said third line of roller means, with both lines being symmetrical about a central line of said horizontal portion, such that a user's bottom is located between said third and fourth roller lines when seated, each of said third and fourth roller means having a rotating axis perpendicular to said flexible support means, a pair of engaging means being engaged between each end of each said support means and said frame portion, each said engaging means comprising at least one funnel hole to receive one end of said flexible support means, a corresponding securing ring being secured to the end of said flexible support means, and an ear portion being secured to said frame portion.

3. An improved chair structure comprising a frame having a vertical portion and a horizontal portion which is mounted on a body, a plurality of flexible support means being horizontally attached across said horizontal portion, a roller means being attached between each two adjacent flexible support means thereby constituting a first line of roller means, a second line of roller means being formed parallel to said first line of roller means with both lines being symmetrical about a central line of said horizontal portion, such that a user's bottom is located between said two roller lines when seated, each of said roller means having a rotating axis perpendicular to said flexible support means, a pair of engaging means being engaged between each end of each said support means and said horizontal frame portion, each said engaging means comprising at least one funnel hole to receive one end of said flexible support means, a corresponding securing ring being secured to the end of said flexible support means, and an ear portion being secured to said horizontal frame portion.

4. An improved chair structure as claimed in claim 3, wherein said roller means are composed of a magnetic material for forming magnetic fluxes therearound.

5. An improved chair structure as claimed in claim 1, wherein said roller means are composed of a magnetic material for forming magnetic fluxes therearound.

6. An improved chair structure as claimed in claim 2, wherein said roller means are composed of a magnetic material for forming magnetic fluxes therearound.

* * * * *